United States Patent [19]

Kollann

[11] 4,189,965

[45] Feb. 26, 1980

[54] REVOLVING CROSS CUTTER

[76] Inventor: Rolf Kollann, Windthorststr. 7, Herlen-Westerholt, Fed. Rep. of Germany

[21] Appl. No.: 937,897

[22] Filed: Aug. 29, 1978

[30] Foreign Application Priority Data

Sep. 29, 1977 [DE] Fed. Rep. of Germany ..... 2743801

[51] Int. Cl.[2] ..... B26D 1/40

[52] U.S. Cl. ..... 83/155; 83/112; 83/118; 83/157; 83/162; 83/345

[58] Field of Search ..... 83/155, 157, 162, 345, 83/112, 118, 109

[56] References Cited

U.S. PATENT DOCUMENTS

| | | | |
|---|---|---|---|
| 2,229,638 | 1/1941 | Chamberlin et al. | 83/112X |
| 3,408,886 | 11/1968 | David | 83/157 X |
| 3,939,744 | 2/1976 | Junker | 83/118 |

*Primary Examiner*—Frank T. Yost

*Attorney, Agent, or Firm*—Sprung, Felfe, Horn, Lynch & Kramer

[57] ABSTRACT

A revolving cross cutter for material in web form comprises two driven knife drums, a transfer table following same in the line of transport of the web and a transport mechanism following the transfer table. The transfer table is mounted for yielding movement in the line of transporting comprising two vertical parallel flat leaf springs which are adjustably biased.

2 Claims, 2 Drawing Figures

REVOLVING CROSS CUTTER

BACKGROUND

The invention relates to a revolving cross cutter for material in web form, consisting of knife drums driven especially in synchronism, of a transfer table and of a transport means having especially upper and lower conveyor belts.

In such cross cutters in which revolving upper knife drums and revolving lower knife drums are used, the transfer of the leading edge of a cut sheet to the transport means is more difficult than it is in cross cutters in which stationary lower knives are used, because, especially when the sheet does not lie sufficiently flat, it tends to follow the lower knife drum. To prevent the sheets from doing this it is common to provide a transfer table between the knife drums and the transport means. The transfer table is installed fixedly in the cross cutter on cross members thereof. Nevertheless, disturbances in the flow of sheets occasionally occurs, and then the transfer table is often deformed by sheet material jamming up against it.

THE INVENTION

The invention is addressed to the object of creating a revolving cross cutter of the kind described above, in which the transfer table will be substantially protected against damage in the event of disturbances such as the jamming up of sheets.

This object is accomplished in accordance with the invention in that the transfer table is disposed on a parallel guide means and is yieldingly supported by a spring of adjustable bias so as to be able to yield in the direction of transport. Preferably, the parallel guide means and spring are disposed in the manner of a parallelogram guide consisting of resilient leaves, especially of flat spring steel, a base which is displaceable in the direction of transport, and a head which bears the transfer table and is urged by the springs against a stop means.

In the revolving cross cutter of the invention, the transfer table is accurately held and guided by quite simple means. If it can be moved into engagement with a stop, it can be adjusted with a variable spring bias to a minimal air gap between its forward edge and the revolving lower knife drum. If a disturbance occurs in the flow of material, it is able to yield resiliently in the transport direction against the bias of the spring, without itself being deformed.

BRIEF DESCRIPTION OF THE DRAWINGS

The invention will be further explained below with the aid of the drawings representing an embodiment, wherein.

DETAILED DESCRIPTION OF THE INVENTION

Figure 1:
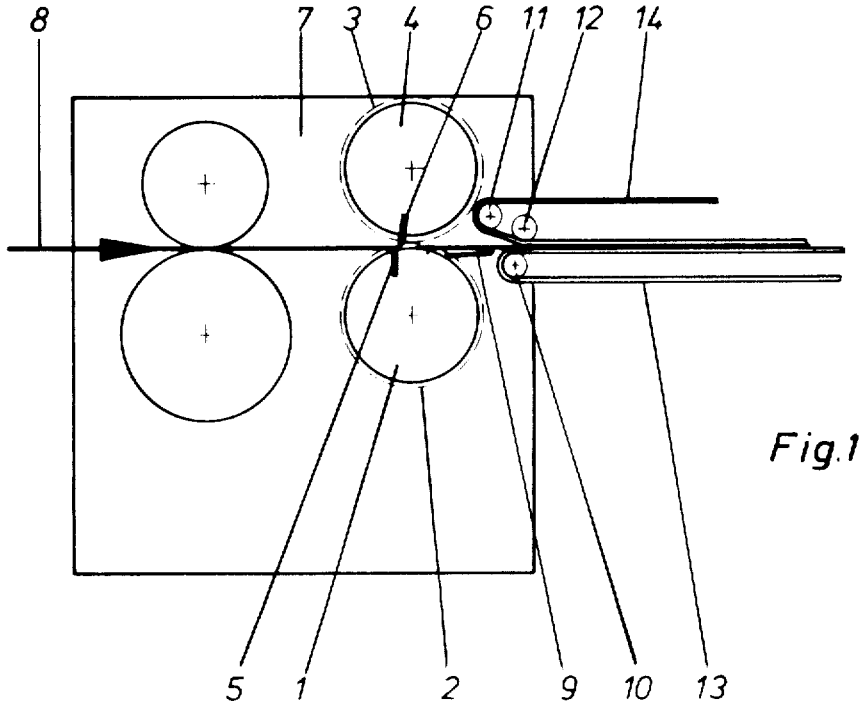
FIG. 1 is a side elevational view of a cross cutter.
Figure 2:
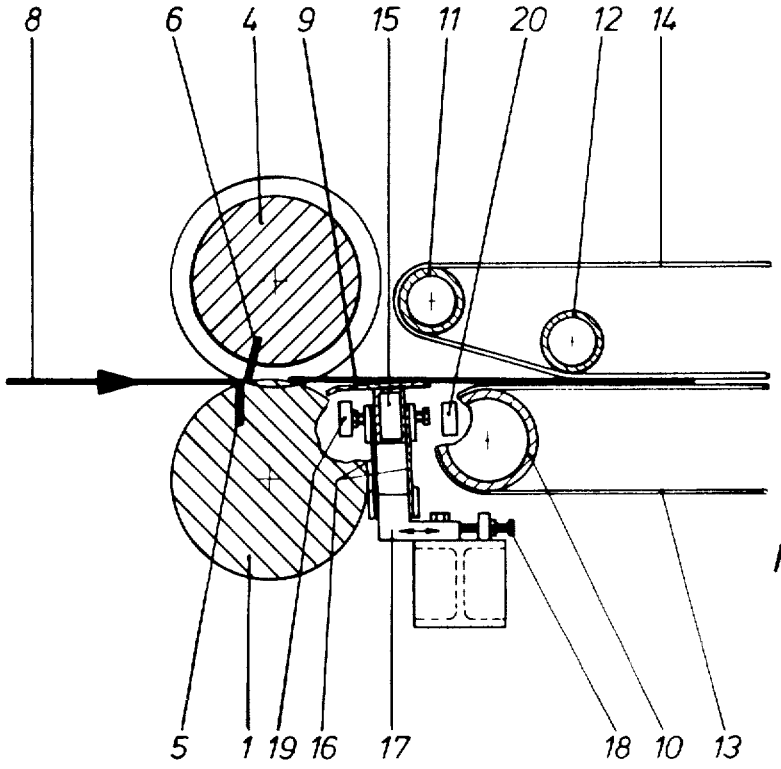
FIG. 2 is a side elevational view on an enlarged scale of a portion of the cross cutter of FIG. 1.

Referring to FIGS. 1 and 2, the revolving cross cutter consists of a lower knife drum 1 and an upper knife drum 4 coupled together by gears 2,3, and each bearing a knife 5,6. The knife drums 1,4 are journaled in a machine frame 7. A web of material 8 is fed to the knife drums 1,4, and is cut into individual sheets by the knife drums 1, 4. The sheets pass over a transfer table 9 to a transport means which consists of the belts 13, 14, running over the pulleys 10,11,12.

The transport table 9 is carried by a cross member 15 which is gripped in two pairs of parallel resilient leaves 16 one on either side of the transport path. The two pairs of resilient leaves 16 are fastened on a base 17 which is disposed displaceably in the machine frame in the manner of a carriage, and is adjustable towards and away from the knife drums 1, 4, by an adjusting screw 18. A fixed stop 19 is associated with the upper ends of the resilient leaves 16. By the displacement of the base 17 the transfer table 9 can be moved into engagement with the stop 19, the bias of the resilient rods 16 being thus adjustable. The two pairs of resilient leaves 16 consist of flat spring steel, so as to provide the table 9 with good guidance while being of simple design.

If any disturbance occurs, such as a jam-up of material against the front edge of the table 9, the latter is able to yield in the transport direction with a resilient bending of the resilient leaves 16. This deflection is limited by stops 20 disposed on both sides of the machine frame, so that the table 9 cannot be forced against the conveyor belt 13 so as to damage it.

It will be appreciated that the instant application and claims are set forth by way of illustration and not limitation, and that various changes and modifications may be made thereto without departing from the spirit and scope of the present invention.

What is claimed is:

1. A revolving cross cutter for material in web form, comprising two driven knife drums, a transfer table following same in the line of transport of the web, and transport means following the transfer table, means mounting the transfer table for yielding movement in the line of transport comprising spring means and means for adjustably biasing same.

2. The revolving cross cutter according to claim 1, wherein the spring means comprises two vertical parallel flat leaf springs, the tops of which are connected to the table and the biasing means comprises means for adjustably guiding the base of the springs and a stop which limits the movement of the top of the spring against the direction of transport.

* * * * *